US008631522B2

(12) United States Patent
Brown

(10) Patent No.: US 8,631,522 B2
(45) Date of Patent: Jan. 21, 2014

(54) NECK GUARD FOR USE IN A SALON/BARBER INDUSTRY SINK

(76) Inventor: Kelley Brown, Austin, TX (US)

( * ) Notice: Subject to any disclaimer, the term of this patent is extended or adjusted under 35 U.S.C. 154(b) by 877 days.

(21) Appl. No.: 12/697,231

(22) Filed: Jan. 30, 2010

(65) Prior Publication Data

US 2011/0185492 A1 Aug. 4, 2011

(51) Int. Cl.
*A45D 44/10* (2006.01)

(52) U.S. Cl.
USPC ..... 4/523

(58) Field of Classification Search
USPC ..... 4/523, 515, 519
See application file for complete search history.

(56) References Cited

U.S. PATENT DOCUMENTS 2,261,476 A * 11/1941 Kiefer ..... 4/519
2,948,903 A * 8/1960 Gilmer ..... 4/523
4,411,032 A 10/1983 Lewy
4,649,580 A * 3/1987 Bastien ..... 4/523
4,669,132 A * 6/1987 Courson ..... 4/523
4,763,364 A 8/1988 Morgan
5,896,595 A 4/1999 Spencer
6,925,660 B1 * 8/2005 Cartwright ..... 4/523
8,112,830 B2 * 2/2012 Brown ..... 4/519

* cited by examiner

*Primary Examiner* — Huyen Le
(74) *Attorney, Agent, or Firm* — Law Offices of Mark L. Berrier

(57) ABSTRACT

A neck guard for a salon/barber industry sink, wherein the sink has an indentation in a lip of the sink to accommodate a person's neck. One embodiment includes a cushioning portion which is curved to fit on top of the indentation, a stabilizing portion which extends downward from the cushioning portion, and a removable cover sheet which is positioned on an upper surface of the cushioning portion. The cushioning portion is rubber having a first durometer and the stabilizing portion is having a second, higher durometer. The stabilizing portion includes front and rear sidewalls, wherein the front sidewall is longer than the rear sidewall. The sidewalls have inner surfaces configured to contact the wall of the sink, wherein the inner surfaces have a traction pattern. One embodiment has a weight of at least one pound.

17 Claims, 2 Drawing Sheets

NECK GUARD FOR USE IN A SALON/BARBER INDUSTRY SINK

BACKGROUND

1. Field of the Invention

The invention relates generally to the salon/barber industry, and more specifically to a neck support for a hard surface sink in the beauty industry.

2. Related Art

Hairstylists often use a specially designed sink to shampoo or rinse chemicals out of their clients' hair. These sinks typically have a curved indentation in the lip in order to allow the person whose hair is being washed/colored to comfortably rest his/her head on the lip of the sink.

All barber/cosmetologist sinks have a very hard surface, typically hard plastic, marble or fiberglass. As a result, it may not be comfortable for a client to rest his/her neck on the lip of the sink for any length of time, and it may even cause neck pain. A cushion (sometimes referred to as a neck guard) is often placed on the lip of the sink at the indentation in order to make the client more comfortable.

Conventional cushions are thick pieces of foam that are molded so that they fit over the indentation in the lip of the sink. The foam must be thick in order to enable the cushion to maintain its shape and thereby maintain its position in the indentation. Because conventional neck guards are normally very thick, they may cause the client's head to rest at an uncomfortable angle. If the client has problems with his or her neck, this may be so uncomfortable as to be intolerable. It is even the case that neck pain has been medically linked to long-term use of shampoo basins. Conventional neck guards place the neck in an unnatural position that can, over time, potentially lead to serious medical conditions.

A conventional neck guard is typically stiff and does not conform well to the shape of the client's neck, or to the shapes of sinks that are not exactly the same as the one for which the neck guard was designed. Since the neck guard does not conform well to the client's neck, it typically allows water and other liquids to run down the neck and back of the client, causing discomfort and potentially ruining the client's clothes. Because the neck guard may not conform well to the sink, liquids may run underneath the neck guard, causing it to slip out of position. This problem is aggravated by the fact that conventional neck guards are relatively lightweight, weighing only between ¼ pound and ½ pound. It should also be noted that, if the neck guard does not conform exactly to the shape of the sink, flexing of the neck guard may cause the one material from which it is constructed to tear, allowing liquids to soak into the neck guard. This reduces the useful life of the neck guard and may also create an unsanitary condition. These problems have lead many hairstylists to simply use towels instead of conventional neck guards.

It would therefore be desirable to provide an improved neck guard which reduces or eliminates one or more of the foregoing problems with conventional neck guards.

SUMMARY OF THE INVENTION

This disclosure is directed to neck guards for salon/barber industry sinks that solve one or more of the problems discussed above. In one particular embodiment, a neck guard includes a cushioning portion which is curved to fit on top of the indentation in the lip of the sink and a stabilizing portion which is attached to the cushioning portion and extends downward from the cushioning portion. The cushioning portion and the stabilizing portion may be formed of two different materials, where the material of the cushioning portion is more compressible than the material of the stabilizing portion. For instance, the cushioning portion may be formed of rubber having a lower durometer and is relatively compressible. The stabilizing portion may be formed of rubber having a higher durometer which is less compressible, more stiff and heavier. In one embodiment, the neck guard weighs between one and two pounds, which helps keep the neck guard in position on the lip of the sink. The length of the front sidewall may be made greater than the length of the rear sidewall in order to increase the weight of the neck guard. The inner surfaces of the sidewalls (the surfaces that contact the sink wall) may include a traction pattern to help hold the neck guard in position on the sink. The traction pattern may, for example, include small, circular, raised areas that maintain good contact with the sink wall even if liquids seep between the neck guard and the sink. A removable, disposable cover sheet may be positioned on the upper surface of the cushioning portion to reduce the transfer of oils, chemicals and other substances from one client to neck guard and then to another client. The cover sheet may be made of paper or other suitable materials and may be adhered to the cushioning portion by a low-tack adhesive or other means.

Numerous other embodiments are also possible.

BRIEF DESCRIPTION OF THE DRAWINGS

Other objects and advantages of the invention may become apparent upon reading the following detailed description and upon reference to the accompanying drawings.

Figure 1:
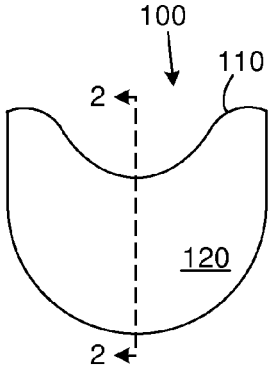
FIG. 1 is a diagram illustrating a front view of an improved neck guard in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF EXEMPLARY EMBODIMENTS

One or more embodiments of the invention are described below. It should be noted that these and any other embodiments described below are exemplary and are intended to be illustrative of the invention rather than limiting.

As described herein, various embodiments of the invention comprise neck guards that provide improved comfort, sanitary conditions, durability and resistance to leakage between a client's neck and the lip of a salon/barber industry sink. In one embodiment, the neck guard is constructed from a solid, yet flexible material such as rubber, which allows the neck guard to conform both to the client's neck and to the shape of the indentation in the sink. The neck guard includes an upper, cushioning portion which is positioned on top of the indentation, as well as a stabilizing portion that has front and rear sidewall portions that extend downward along the sides of the sink below the indentation to hold the neck guard in place.

In one embodiment, the cushioning portion of the neck guard is made from a more compressible material than the sidewalls in order to provide increased comfort to the client. The cushioning portion is thinner than the corresponding portion of a conventional neck guard in order to prevent the client's neck from being raised to an uncomfortable height, but still provides comfort to the client because of the compressibility of the material and the more curved shape than the conventional neck guard. This also serves to provide a better seal between the neck guard and the client's neck so that there is little or no leakage of fluids along the client's neck and onto the client's clothing.

The sidewall portions of the neck guard are intended to hold the neck guard in place, so they may be made from a less compressible and a somewhat less flexible material then the cushioning portion. For example, the sidewalls may use a higher-durometer rubber, while the cushioning portion uses a lower-durometer rubber. (The "durometer" is a measure of the hardness of the rubber.) The rubber is substantially impermeable to liquids and consequently does not allow liquids to seep into the neck guard and thereby create an unsanitary condition. In one embodiment, the front sidewall is larger than the rear sidewall to allow the weight of the neck guard to be increased. The weight may also be increased by the use of more dense material in the sidewalls than in the cushioning portion of the neck guard. The increased weight and the force of gravity causes the neck guard to remain more securely positioned over the indentation in the sink.

The underside of the neck guard may have a patterned surface to provide greater friction against the surface of the sink to keep the neck guard even more securely positioned over the indentation. A removable cover sheet may be adhered to the cushioning portion of the neck guard in order to provide a protective layer between the neck guard and the client's neck. This layer is preferably a liquid impermeable paper that can be replaced before each use of the neck guard.

Figure 2:
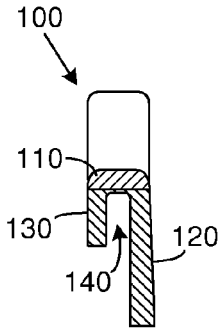
FIG. 2 is a diagram illustrating a cutaway side view of a portion of an improved neck guard in accordance with one embodiment.
Figure 3:
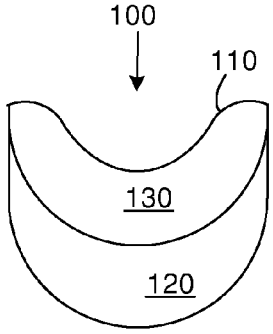
FIG. 3 is a diagram illustrating a rear view of an improved neck guard in accordance with one embodiment.

Referring to FIGS. 1-3, one embodiment of an improved neck guard 100 is illustrated. FIG. 1 is a front view of the neck guard, FIG. 2 is a cutaway side view of the neck guard, and FIG. 3 is a rear view of the neck guard. Neck guard 100 includes an upper, cushioning portion 110, a front sidewall 120 and a rear sidewall 130. Cushioning portion 110 is curved to fit on top of the indentation in a salon/barber industry sink. Front sidewall 120 and rear sidewall 130 extend downward from cushioning portion 110, leaving a gap 140 between them. When neck guard 100 is installed on a sink, the indented lip of the sink fits within gap 140, so that cushioning portion 110 sits on top of the indentation with sidewalls 120 and 130 extending downward along the inner and outer surfaces of the sink wall.

Figure 4:
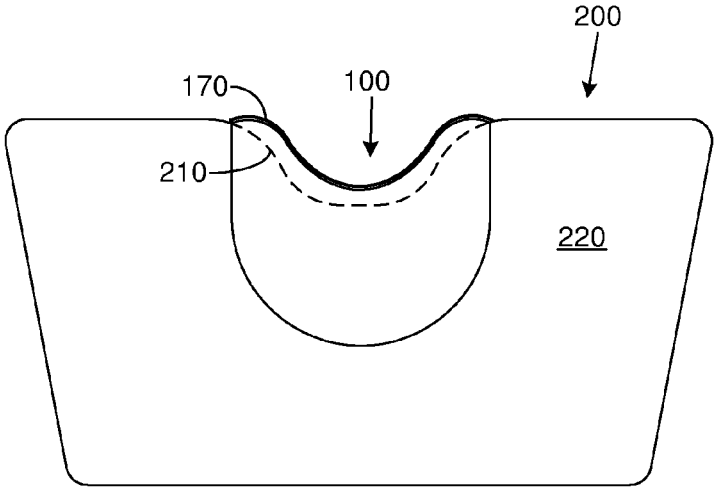
FIG. 4 is a diagram illustrating a front view of a salon/barber industry sink with a neck guard installed over the indentation in the lip of the sink
Figure 5:
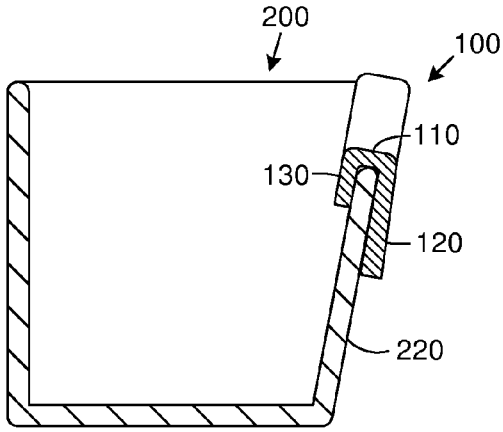
FIG. 5 is a diagram illustrating a cross-section of the lip of a salon/barber industry sink with a neck guard in accordance with one embodiment installed over the lip.

Referring to FIGS. 4 and 5, neck guard 100 is shown installed on the lip of a salon/barber industry sink 200. FIG. 4 is a front view of the sink and neck guard, while FIG. 5 is a cutaway side view. In these figures, it can be seen that sink 200 has an indentation 210 in its front wall 220, as illustrated by the dashed line in the figure. Neck guard 100 is curved to fit within indentation 210. Front sidewall 120 of neck guard 100 extends downward along the outside of wall 220, while rear sidewall 130 extends downward along the inside of wall 220.

Figure 6:
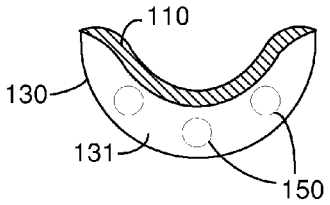
FIG. 6 is a diagram illustrating a cutaway front view of a portion of an improved neck guard in accordance with one embodiment.
Figure 7:
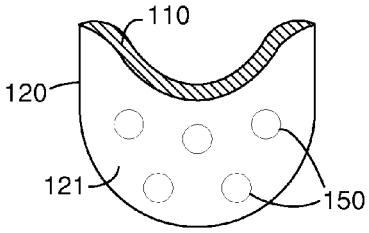
FIG. 7 is a diagram illustrating a cutaway rear view of a portion of an improved neck guard in accordance with one embodiment.

Referring again to FIGS. 1-3, the illustrated embodiment is approximately 6 inches wide (from side-to-side across the indentation) and 5 inches high overall. The neck guard is approximately 2 inches deep from front to back. (It should be noted that conventional neck guards are normally no more than 1.5 inches deep.) The cushioning portion 110 and sidewalls 120, 130 are each approximately one-half inch thick (from the surface contacting the sink to the opposing, outward-facing surface). As shown in FIGS. 6 and 7, which are cutaway views of neck guard 100, cushioning portion 110 is approximately the same thickness along most of the indentation, but tapers at the edges of the neck guard which are near the ends of the indentation. FIG. 6 is a front view showing rear sidewall 130 and a cross-section of cushioning portion 110. FIG. 7 is a rear view showing front sidewall 120 and a cross-section of cushioning portion 110.

Referring again to FIG. 2, it should be noted that front sidewall 120 tapers to a greater thickness at the bottom of the sidewall. The increased thickness of the sidewall in this embodiment adds weight to the neck guard. The added weight is provided in order to increase the (gravitational) force pushing the neck guard downward onto the lip of the sink, thereby helping to keep the neck guard in position over the indentation. In one embodiment, the weight of the neck guard is approximately two pounds, although weight as low as about one pound may be helpful to keep the neck guard in position.

Figure 8:
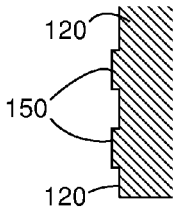
FIG. 8 is a diagram illustrating a cutaway side view of a sidewall of an improved neck guard in accordance with one embodiment.

In one embodiment, the inner surfaces of sidewalls 120 and 130 are patterned to increase the "traction" of the sidewalls against the wall of the sink. Referring again to FIGS. 6 and 7, the traction pattern on the inner surfaces of the neck guard is shown. Inner surfaces 121 and 131 of sidewalls 120 and 130 face gap 140, and are positioned against the outer and inner surfaces of the sink wall when the neck guard is installed over the indentation in the lip of the sink. Each of inner surfaces 121 and 131 includes several raised, circular "feet" 150. Feet 150 are simply circular areas that are raised (i.e., extend outward slightly) from inner surfaces 121 and 131. FIG. 8 shows a cross-section of front sidewall 120. It can be seen this figure that feet 150 extend only slightly outward from inner surface 121. Because feet 150 extend outward from the inner surfaces, any liquids which seep under the neck guard will tend to flow around the feet, leaving the feet in contact with the surface of the sink and maintaining increased traction (friction) between the neck guard and the sink so that the neck guard does not slip out of position. If the inner surfaces were smooth and flat, liquids that might seep between the neck guard and the sink would tend to form a layer between them, allowing the neck guard to slip out of position.

In one embodiment, a cover layer is removably attached to cushioning portion 110. The cover layer is provided for sanitary purposes. When conventional neck guards are used, a client's neck lies directly on the neck guard. Hair, chemicals, dirt, oils, dirty water and the like can be transferred from the client's neck to the neck guard and may even be absorbed into the foam of the neck guard. These substances may then be transferred to another client, or they may cause the material of the neck guard to have an unpleasant odor or even deteriorate. The protective cover layer helps prevent these substances from touching the neck guard and can be removed, discarded and replaced with a new cover layer, thereby preventing the unsanitary transfer of dirt and other substances from one client to another.

Referring again to FIG. 4, cover layer 170 is positioned on an upper surface of cushioning portion 110. In one embodiment, the cover layer is a strip of paper that is about as wide as the neck guard (from front to back) and long enough to extend from one side to the other (from left to right in the figure). Cover layer 170 may be adhered to cushioning portion 110 by means of an adhesive. The adhesive may be a glue, wax or other type of low-tack pressure sensitive adhesive. The adhesive may, for example, be applied as a layer between cover layer 170 and cushioning portion 110. Alternatively, adhesive may be applied to the ends of cover layer 170, so that the ends of the cover layer may be wrapped around the sides of the neck guard and adhered to the underside of the neck guard. Cover layer 170 can be removed and reapplied to cushioning portion 110 or removed and replaced by a new cover layer.

The cover layer of the neck guard consists of a material such as paper or cloth. The cover layer is not intended to provide any cushioning or strength, but simply prevents the transfer of chemical residue, dirt, debris, and other unsanitary materials from a client's neck to the cushioning layer. Conversely, if any of these unsanitary materials are deposited on the cushioning layer, removal of the cover layer and replacement with a new cover layer prevents transfer of the materials from the cushioning layer to the neck of the next client to use the neck guard.

The cover layer is preferably impermeable to the unsanitary materials, but if a material such as a permeable fabric is used, the cover layer may be washable so that it can be sanitized. Whether the cover layer is permeable or not, it is preferably made of a material that is "breathable" (i.e., allows some air to reach the client's neck) so that the neck guard is more comfortable.)

In one embodiment, the different portions of the neck guard are made of different materials. For instance, the cushioning portion may be made of a softer material to increase the client's comfort, while the sidewalls are made of a more stiff material to keep the neck guard in position over the indentation in the wall of the sink. The sidewalls may also be made of heavier material in order to increase the weight of the neck guard so that it is more likely to stay in position on the sink. It may, however, be possible to find the desired characteristics in a single material, in which case the entire neck guard may be formed from this single material.

Figure 9:
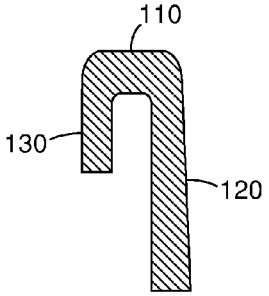
FIG. 9 is a diagram illustrating a cutaway side view of a portion of an improved neck guard in accordance with one embodiment.
Figure 10:
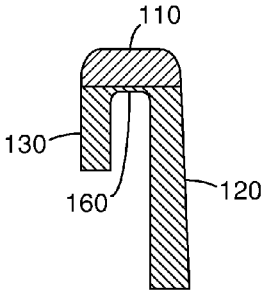
FIG. 10 is a diagram illustrating a cutaway side view of a portion of an improved neck guard in accordance with an alternative embodiment.
Figure 11:
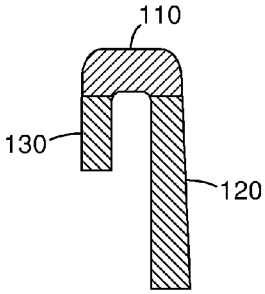
FIG. 11 is a diagram illustrating a cutaway side view of a portion of an improved neck guard in accordance with another alternative embodiment.

Referring to FIGS. 9-11, three possible constructions of the neck guard are illustrated. FIG. 9 is a cutaway side view of a neck guard that is made from a single type of material. FIGS. 10 and 11 are cutaway side views of neck guards that are each made from two different types of material.

Referring to FIG. 9, it can be seen that both cushioning portion 110 and sidewalls 120 and 130 of the neck guard are made of a single material. Referring to FIG. 10, two different materials are used to make the neck guard. In this embodiment, sidewalls 120 and 130 are made of a first material, such as a higher-durometer rubber that will hold the neck guard securely on the sink wall. A small connecting portion 160 of the same material extends from front sidewall 120 to rear sidewall 130. A second material such as a lower-durometer rubber is used to form cushioning portion 110 on top of connecting portion 160. Referring to FIG. 11, two different materials are again used to make the neck guard. In this embodiment, sidewalls 120 and 130 are made of the first material, but the two sidewalls are not connected by the same material. Instead, each of the sidewalls is connected to cushioning portion 110, which is formed from the second material. In each of the embodiments of FIGS. 9-11, the neck guards may be formed by injecting or otherwise shaping the appropriate material(s) in a mold.

As noted above, the embodiments described above are intended to be exemplary, and alternative embodiments may include variations of the features described above. For example, while the exemplary embodiments are formed of rubber, other materials may be used. Preferably, these materials will be flexible enough to prevent tearing of the material, yet rigid enough to maintain the position of the neck guard over the indentation in the sink wall. Also, the materials will preferably be non-absorbent, so that liquids will not be absorbed into or retained within the neck guard. It may therefore be preferable to use solid materials instead of foam materials that include voids, or cells. As also noted above, the neck guard may be made of a single, relatively homogeneous material, or it may use multiple materials in the different portions of the neck guard. Further, the inner surfaces of the neck guard may have different traction patterns than those described above, or they may have no traction patterns at all. Still further, alternative embodiments need not have different-sized sidewalls on the front and rear of the neck guard. Still further, alternative embodiments may use different means to adhere the cover layer to the cushioning layer, or may be made of materials other than those described above.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A neck guard for a salon/barber industry sink, wherein the sink has an indentation in a lip of the sink to accommodate a person's neck, the neck guard comprising:

a cushioning portion which is curved to fit on top of the indentation in the lip of the sink;

a stabilizing portion which is attached to the cushioning portion and extends downward from the cushioning portion; and a removable cover sheet which is positioned on an upper surface of the cushioning portion;

wherein the cushioning portion is formed of non-absorbent, voidless rubber of a first durometer and the stabilizing portion is formed of rubber of a second durometer which is greater than the first durometer;

wherein the stabilizing portion comprises a front sidewall configured to be positioned against an outside wall of the sink and a rear sidewall configured to be positioned against an inside wall of the sink, wherein a length of the front sidewall from the cushioning portion is greater than a length of the rear sidewall from the cushioning portion, wherein the front sidewall has a first inner surface configured to contact the outside wall of the sink and the rear sidewall has a second inner surface configured to contact the inside wall of the sink, wherein the first and second inner surfaces have a traction pattern which includes a plurality of areas that are raised with respect to the first and second inner surfaces;

wherein the front sidewall tapers from a first thickness at an upper end to a second, greater thickness at a lower end and is weighted so that the neck guard has a weight of at least one pound.

2. A neck guard for a salon/barber industry sink, wherein the sink has an indentation in a lip of the sink to accommodate a person's neck, the neck guard comprising:

a cushioning portion which is curved to fit on top of the indentation in the lip of the sink; and a stabilizing portion which is attached to the cushioning portion and extends downward from the cushioning portion;

wherein the cushioning portion is formed of a first material and the stabilizing portion is formed of a second material, wherein the first material is non-absorbent and voidless and is more compressible than the second material; and wherein the front sidewall tapers from a first thickness at an upper end to a second, greater thickness at a lower end and is weighted so that the neck guard has a weight of at least one pound.

3. The neck guard of claim 2, wherein the stabilizing portion comprises a front sidewall configured to be positioned against an outside wall of the sink and a rear sidewall configured to be positioned against an inside wall of the sink, wherein a length of the front sidewall from the cushioning portion is greater than a length of the rear sidewall from the cushioning portion.

4. The neck guard of claim 2, wherein the first material comprises rubber of a first durometer and the second material comprises rubber of a second durometer which is greater than the first durometer.

5. The neck guard of claim 2, wherein the stabilizing portion comprises a front sidewall configured to be positioned against an outside wall of the sink and a rear sidewall configured to be positioned against an inside wall of the sink, wherein the front sidewall has a first inner surface configured to contact the outside wall of the sink and the rear sidewall has a second inner surface configured to contact the inside wall of the sink, wherein at least one of the first and second inner surfaces has a traction pattern.

6. The neck guard of claim 5, wherein both the first and second inner surfaces have the traction pattern, and wherein the traction pattern comprises a plurality of areas that are raised with respect to the first and second inner surfaces.

7. The neck guard of claim 2, further comprising a removable cover sheet which is positioned on an upper surface of the cushioning portion.

8. The neck guard of claim 7, wherein the cover sheet comprises a disposable paper material and is adhered to the cushioning portion by a low-tack adhesive.

9. The neck guard of claim 2, wherein the second material is sufficiently rigid to maintain the stabilizing portion in a shape of the indentation in the lip of the sink.

10. A neck guard for a salon/barber industry sink, wherein the sink has an indentation in a lip of the sink to accommodate a person's neck, the neck guard comprising:

a cushioning portion which is curved to fit on top of the indentation in the lip of the sink; and a stabilizing portion which is attached to the cushioning portion and extends downward from the cushioning portion;

wherein the cushioning portion is formed of a first material that is non-absorbent and voidless;

wherein the stabilizing portion comprises a front sidewall configured to be positioned against an outside wall of the sink and a rear sidewall configured to be positioned against an inside wall of the sink, wherein a length of the front sidewall from the cushioning portion is greater than a length of the rear sidewall from the cushioning portion; and wherein the front sidewall tapers from a first thickness at an upper end to a second, greater thickness at a lower end and is weighted so that the neck guard has a weight of at least one pound.

11. The neck guard of claim 10, wherein the stabilizing portion is formed of a second material, wherein the first material is more compressible than the second material.

12. The neck guard of claim 11, wherein the first material comprises rubber of a first durometer and the second material comprises rubber of a second durometer which is greater than the first durometer.

13. The neck guard of claim 10, wherein the front sidewall has a first inner surface configured to contact the outside wall of the sink and the rear sidewall has a second inner surface configured to contact the inside wall of the sink, wherein at least one of the first and second inner surfaces has a traction pattern.

14. The neck guard of claim 13, wherein both the first and second inner surfaces have the traction pattern, and wherein the traction pattern comprises a plurality of areas that are raised with respect to the first and second inner surfaces.

15. The neck guard of claim 10, further comprising a removable cover sheet which is positioned on an upper surface of the cushioning portion.

16. The neck guard of claim 15, wherein the cover sheet comprises a disposable paper material and is adhered to the cushioning portion by a low-tack adhesive.

17. The neck guard of claim 10, wherein the stabilizing portion is formed of a second material, and wherein the second material is sufficiently rigid to maintain the stabilizing portion in a shape of the indentation in the lip of the sink.

* * * * *